US006684943B2

(12) United States Patent
Dobbs et al.

(10) Patent No.: US 6,684,943 B2
(45) Date of Patent: Feb. 3, 2004

(54) PLATE-TYPE HEAT EXCHANGER

(75) Inventors: Gregory M. Dobbs, Glastonbury, CT (US); James D. Freihaut, South Windsor, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/160,370

(22) Filed: May 31, 2002

(65) Prior Publication Data

US 2002/0185266 A1 Dec. 12, 2002

Related U.S. Application Data

(63) Continuation of application No. 09/470,165, filed on Dec. 22, 1999, now abandoned.
(60) Provisional application No. 60/158,533, filed on Oct. 10, 1999.

(51) Int. Cl.[7] ..... B01D 53/22; F28F 3/00
(52) U.S. Cl. ..... 165/166; 96/7
(58) Field of Search ..... 165/166, 905; 96/7

(56) References Cited

U.S. PATENT DOCUMENTS 2,917,292 A * 12/1959 Hittrich ..... 261/7
3,498,372 A * 3/1970 Patten et al. ..... 165/166
4,409,339 A * 10/1983 Matsuda et al. ..... 521/143

* cited by examiner

*Primary Examiner*—Allen Flanigan
(74) *Attorney, Agent, or Firm*—Wall Marjama & Bilinski & Bilinski LLP

(57) ABSTRACT

Existing plate-type heat exchangers typically include plates that are constructed of metal or paper, which are only capable of transferring a limited amount of moisture, if any, from one side of the plate to the other side. The present invention is a plate-type heat exchanger wherein the plates are constructed of ionomer membranes, such as sulfonated or carboxylated polymer membranes, which are capable of transferring a significant amount of moisture from one side of the membrane to the other side. Incorporating such ionomer membranes into a plate-type heat exchanger provides the heat exchanger with the ability to transfer a large percentage of the available latent heat in one air stream to the other air streams. The ionomer membrane plates are, therefore, more efficient at transferring latent heat than plates constructed of metal or paper.

12 Claims, 10 Drawing Sheets

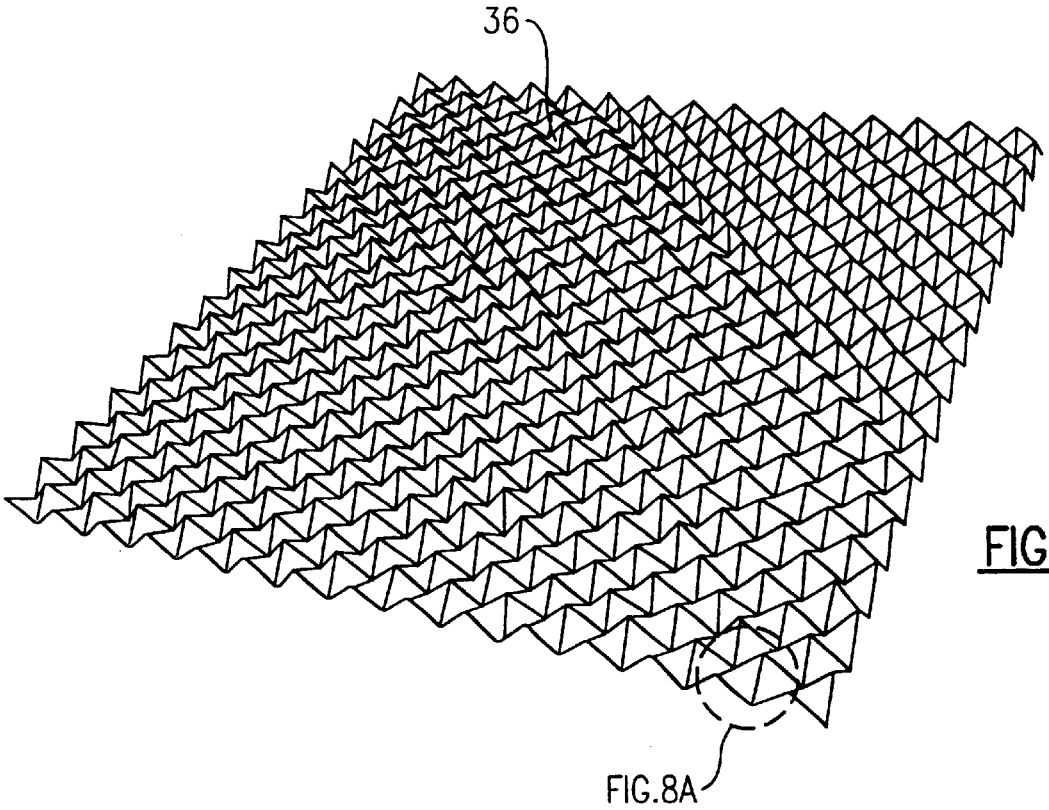
FIG.8
FIG.8A
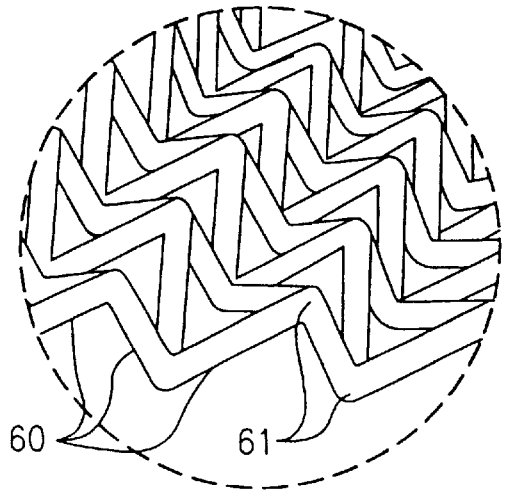

PLATE-TYPE HEAT EXCHANGER

CROSS REFERENCE TO RELATED APPLICATIONS

This application claims benefit of U.S. Provisional Application No. 60/158,533, filed Oct. 10, 1999. This is also a continuation application of U.S. Ser. No. U.S. Ser. No. 09/470,165, filed Dec. 22, 1999, now abandoned, the entirety of which is incorporated herein by reference.

TECHNICAL FIELD

This invention relates to a plate-type exchanger and more particularly, to a plate-type heat exchanger wherein the plates comprise a polymer membrane having enhanced moisture transfer properties.

BACKGROUND ART

Heating, ventilation and air conditioning (HVAC) systems typically recirculate air, exhaust a portion of the re-circulating air, and simultaneously replace such exhaust air with fresh air. In order to maintain an air temperature and humidity level within a certain space at or near a set point, it is desirable to condition the fresh air the temperature and humidity level set point. Unfortunately, the temperature and humidity of fresh air often differ substantially from those of the set points. For example, during hot and humid periods, such as the summer months, the incoming fresh air typically has a higher temperature and/or humidity level than desired. Additionally, during cold and/or dry periods, such as the winter months, the incoming fresh air typically has a lower temperature and humidity level than desired. The HVAC system must, therefore, condition the fresh air before introducing it to the room.

HVAC systems are typically designed according to the worst climatic conditions for the geographic area in which the HVAC system will be located. Such worst case climatic conditions are referred to as a cooling and heating "design day." Conditioning the fresh air during such extreme climatic conditions creates a significant load on the HVAC system. System designers, therefore, typically design the HVAC system with sufficient capacity to maintain the set point during the design day conditions. In order to create the required capacity, the HVAC system may include oversized equipment. Alternatively, as discussed in U.S. Pat. No. 4,051,898, which is hereby incorporated by reference, in order to reduce the load on the HVAC system, system designers often incorporate ventilators within the HVAC system. Reducing the ventilation load on the HVAC system decreases its capacity requirements, which, in turn, allows the designers to specify smaller sized equipment, thereby leading to a more efficient design.

Referring to FIG. 1, a ventilator 10 typically includes a plate-type heat exchanger 12 which creates alternating flow passages for the fresh air stream and exhaust air stream to pass therethrough. The flow passages are typically either parallel or perpendicular to one another. This figure illustrates a cross flow heat exchanger because the alternating flow passages are perpendicular to one another. Specifically, one air stream enters the ventilator 10 through opening 11, passes through the plate-type heat exchanger 12, and exits the ventilator 10 through opening 13, and the other air stream enters the ventilator 10 through opening 15, passes through the plate-type heat exchanger 12, and exits the ventilator 10 through opening 17. However, if the alternating flow passages are parallel to one another and the air streams are in the same direction, then the heat exchanger is referred to as a co-flow heat exchanger. Additionally, if the alternating flow passages are parallel to one another but the air streams directly oppose one another, then the heat exchanger is referred to as a counterflow heat exchanger.

Regardless of the direction of the flow patterns, as the air streams pass through the passageway and along opposite sides of the plates, the heat or energy in one air stream is transferred to the other air stream. Depending upon the material of the plates 20, they can transfer sensible heat or both sensible and latent heat. Specifically, if the plates 20 are constructed of a material that is only capable of transferring sensible heat, then the ventilator is referred to as a heat recovery ventilator (HRV). If, however, the plates 20 are constructed of a material that is capable of transferring latent heat, as well as sensible heat, then the ventilator is referred to as an energy recovery ventilator (ERV). For example, metal plates, such as aluminum plates, absorb a portion of the thermal energy in one air stream and transfer such energy to the other air stream by undergoing a temperature change without allowing any moisture to pass therethrough. Therefore, a ventilator constructed of metal plates is referred to as a HRV. Although plates 20 constructed of paper typically have a lower thermal conductivity than metal, paper may be capable of transferring some sensible heat. These plates, however, are capable of transferring some latent heat because such materials are capable of transferring moisture between air streams. A ventilator having plates constructed of material capable of transferring moisture between air streams is, therefore, referred to as an ERV.

It is generally understood that an ERV is more versatile and beneficial than an HRV. However, materials such as paper limit the plate's ability to transfer a larger portion of the latent heat from one air stream to the other air stream. Therefore, it is desirable to produce an ERV with a plate having a greater latent heat transfer efficiency. The cost of the more efficient material, however, cannot disrupt the cost benefit of including an ERV within a HVAC system. As discussed hereinbefore, utilizing a ventilator to pre-condition the fresh air is an alternative to increasing the size of the HVAC system. Specifically, pre-conditioning the fresh air allows the system designers to utilize a design day having more moderate parameters, which, in turn, make possible the inclusion of smaller, less costly equipment. Such equipment will also consume less energy, thereby making it less expensive to operate. Hence, including an ERV within a HVAC system is perceived as a low cost method for increasing the system's overall operating efficiency. However, if the cost of a more efficient plate material significantly increases the first cost of the ERV, then including an ERV within a HVAC system decreases its financial benefit. Therefore, it is desirable that the plates within the plate-type heat exchanger be constructed of a low cost material, as well as a material that has the ability to effectively transfer latent heat.

Another alternative to increasing the plate material's ability to transfer latent heat is to pressurize the ERV because pressurizing the ERV increases the plate's ability to transfer latent heat from one air stream to the other by increasing the water concentration difference across the plate. A typical HVAC system, however, currently operates at about ambient pressure. Therefore, pressurizing the HVAC system and more particularly, the ERV, would require adding additional equipment, such as a compressor, to the HVAC system. Although pressurizing the ERV would increase its efficiency, adding the necessary equipment to pressurize the ERV would increase the HVAC system's overall cost. Again, including an ERV within a HVAC system is currently perceived as a low cost method for increasing its overall efficiency because doing so decreases the size and operating cost of the HVAC system. Pressurizing the HVAC system, alternatively, would only increase the size of such system by additional equipment, thereby eliminating the cost benefit of adding an ERV to an HVAC system.

What is needed is a plate-type heat exchanger wherein the plates are constructed of a cost effective material, other than paper, that is capable of transferring a larger percentage of the available latent heat in one air stream to the other air streams, while maintaining the ERV's ability to operate at about ambient pressure.

DISCLOSURE OF INVENTION

The present invention is a plate-type heat exchanger wherein the plates are ionomer membranes, such as sulfonated or carboxylated polymer membranes, which are capable of transferring a significant amount of moisture from one of its side to the other. Because the ionomer membrane plates are capable of transferring a significant amount of moisture, the plate-type heat exchanger is capable of transferring a large percentage of the available latent heat in one air stream to the other air streams. Therefore, a heat exchanger having ionomer membrane plates is more efficient than a heat exchanger constructed of paper plates. Utilizing such a material not only improves the latent effectiveness factor of the ERV, but does so without pressuring the HVAC system or adding additional equipment, thereby improving the cost benefit of including an ERV within an HVAC system.

Accordingly the present invention relates to a plate-type heat exchanger, including a plurality of parallel plates spaced apart from one another to thereby form alternating first and second passageways for a first gas stream and a second gas stream to pass therethrough, respectively, the plates being comprised of a ionomer membrane having four sides, a means for spacing apart the parallel plates from one another, a means for sealing two opposing sides of the first passageways thereby allowing the first gas stream to pass therethrough in a first direction, and a means for sealing two opposing sides of the first passageways thereby allowing the second gas stream to pass therethrough in a second direction.

In an alternate embodiment of the present invention, the ionomer membranes may be sulfonated or carboxylated polymer membranes, which can be produced by sulfonating or carboxylating hydrocarbon or perfluronated polymers. Therefore, in a further embodiment of the present invention, the sulfonated or carboxylated polymer membrane shall comprise a perfluronated backbone chemical structure. In an even further alternate embodiment of the present invention, the sulfonated or carboxylated polymer membrane shall comprise a hydrocarbon backbone chemical structure.

Both the sulfonated polymer membrane, comprising the perfluoronated backbone chemical structure, and the sulfonated polymer membrane, comprising the hydrocarbon chemical structure, significantly improve the plate-type heat exchanger's ability to transfer latent heat between air streams in comparison to the currently available plate-type heat exchangers comprising paper plates because both types of sulfonated polymer membranes have the ability to transfer a significantly greater amount of moisture. Additionally, the sulfonated polymer membrane comprising the hydrocarbon backbone structure is typically less expensive to manufacture than a sulfonated polymer membrane comprising a perfluoronated backbone structure because fluorine chemical processing is typically more expensive than ordinary hydrocarbon organic chemistry. Therefore, although there is a cost benefit for including an ERV having a plate-type heat exchanger constructed of sulfonated polymer membranes with a perfluoronated backbone structure into an HVAC system, utilizing plates constructed of sulfonated polymer membranes having a hydrocarbon backbone would further increase the ERV's cost benefit.

The foregoing features and advantages of the present invention will become more apparent in light of the following detailed description of exemplary embodiments thereof as illustrated in the accompanying drawings.

BRIEF DESCRIPTION OF THE DRAWINGS

FIG. 8 is a sheet of a lattice structure.

FIG. 8A is an enlargement of a portion of the corrugated lattice structure sheet in FIG. 8.

BEST MODE FOR CARRYING OUT THE INVENTION

Figure 1:
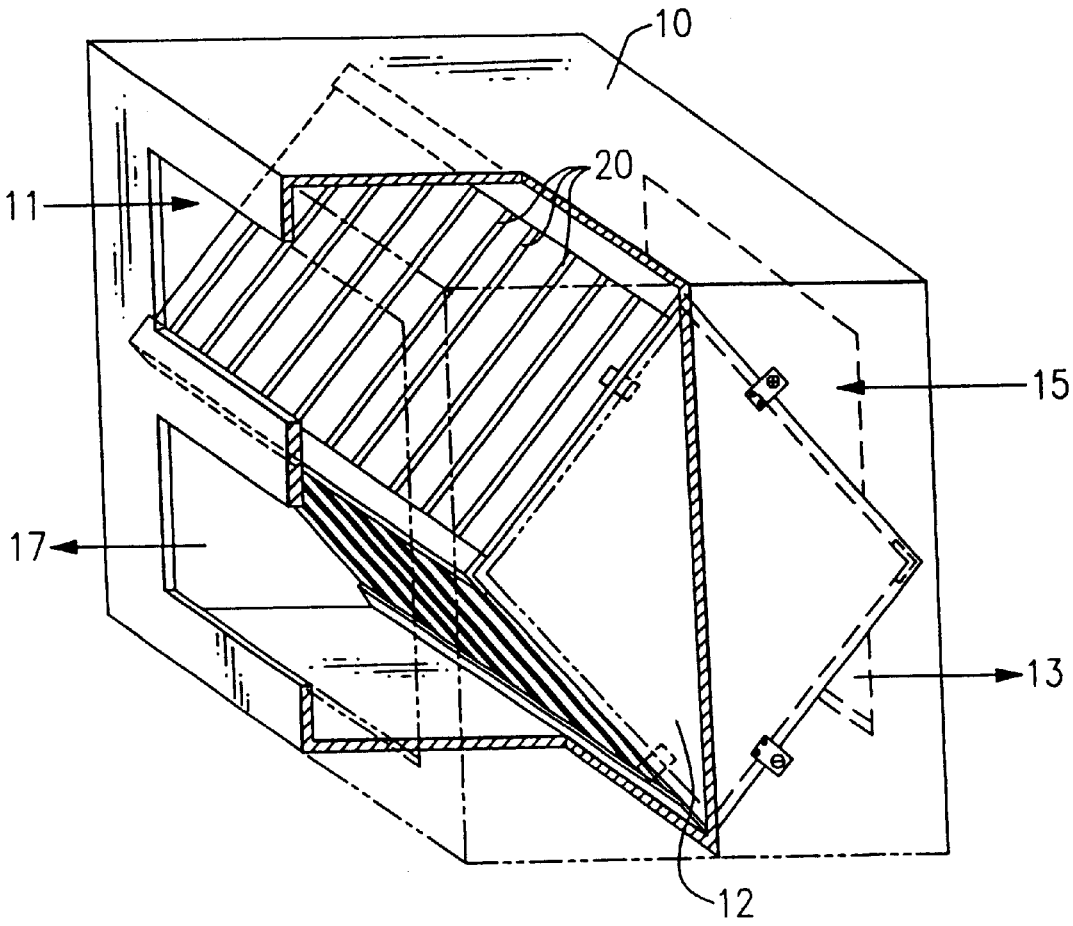
FIG.1 Prior Art
FIG. 1 illustrates a ventilator comprising a prior art plate-type heat exchanger having a plurality of alternating counter flow passageways therein.
Figure 2:
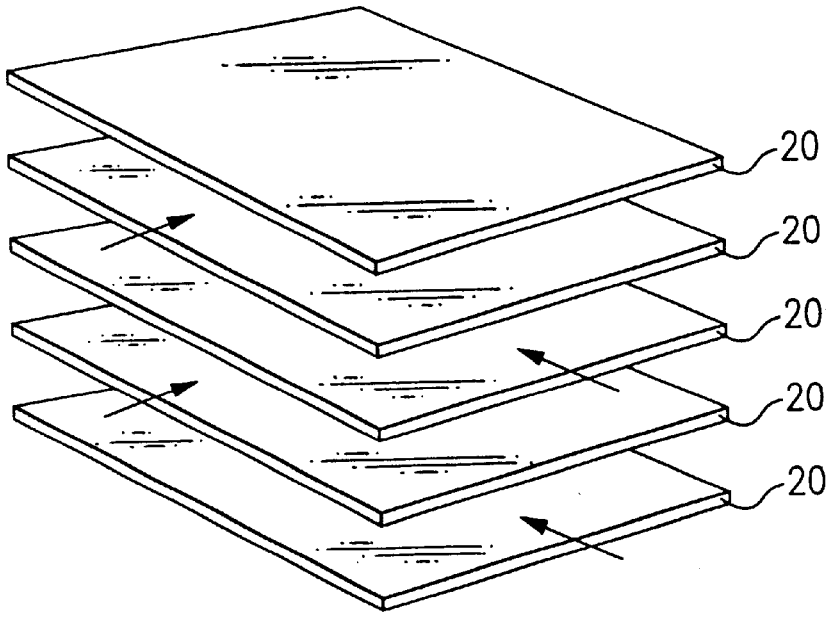
FIG. 2 illustrates a plurality of ionomer membrane plates for constructing a plate-type heat exchanger.

Referring to FIG. 2, there is shown a plurality of plates 20 spaced apart from one another to form passageways (i.e., gaps or spaces) between the plates 20. The plates 20 are constructed of an ionomer membrane, which has a high moisture transfer characteristic. An ionomer membrane shall mean a membrane composed of an ion containing polymer, such as a sulfonated polymer membrane or a carboxylated polymer membrane that is capable of transferring moisture from one of its sides to the other. A sulfonated polymer membrane shall mean a layer of polymer comprising a sulfonated ion ($SO_3^{-/+}$) within its chemical structure. The sulfonated ion ($SO_3^{-/+}$) is typically located within the side chain of a polymer having a perfluoronated or hydrocarbon backbone structure. Examples of a generic chemical structure for a sulfonated polymer membrane comprising a perfluoronated backbone chemical structure includes the following:

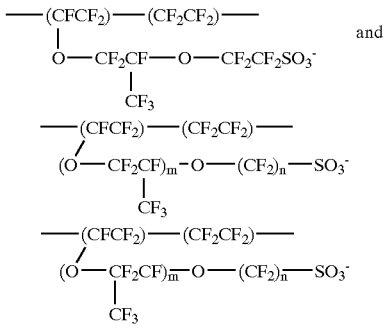

and wherein, m and n are comparable variables;

and

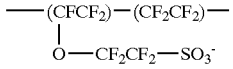

Moreover, examples of commercially available sulfonated polymer membranes having a perfluoronated chemical structure include those membranes manufactured by W. L. Gore & Associates, Inc., of Elkton, Md. and distributed under the tradename GORE-SELECT and those perfluoronated membranes manufactured by E. I. du Pont de Nemours and Company and distributed under the tradename NAFION.

An example of a generic chemical structure for a sulfonated polymer membrane comprising a hydrocarbon backbone chemical structure includes the following:

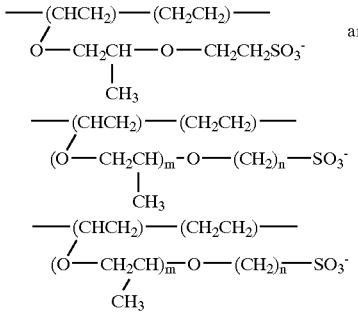

and wherein, m and n are comparable variables;

and

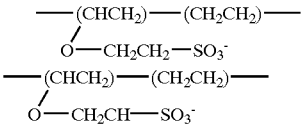

Moreover, an example of a commercially available sulfonated polymer membrane having a hydrocarbon backbone chemical structure includes the polymer membrane manufactured by the Dais Corporation, of Odessa, Fla., and distributed under the product name DAIS 585. The cost of sulfonated polymer membranes comprising a hydrocarbon backbone chemical structure is currently about one percent (1%) to ten percent (10%) of the cost of sulfonated polymer membranes comprising a perfluoronated backbone chemical structure. Therefore, it is especially preferable for the plates 20 of a plate-type heat exchanger to be constructed of sulfonated polymer membranes comprising a hydrocarbon backbone chemical structure because incorporating such plates into an ERV improves its latent effectiveness factor while minimizing its cost.

The sulfonated polymer membranes do not necessarily require a hydrocarbon or perfluoronated backbone chemical structure. Rather, the backbone could be a block or random copolymer. The desirable thickness of the sulfonated polymer membranes is dependent upon the their physical properties, which are controlled by the chemical backbone structure, length of side chains, degree of sulfonation, and ionomic form (i.e., acid, salt, etc.). However, such block or random copolymer must have the ionic sulfonate group ($SO_3$). Additionally, the polymer membrane may be fully or partially sulfonated. Altering the degree of sulfonation affects the polymer membrane's ability to transfer moisture, and it is generally preferable to have a high degree of sulfonation within the polymer membrane.

It may also be preferable to utilize a carboxylate polymer membrane in lieu of a sulfonated polymer membrane if the carboxylate polymer membrane is able to transfer moisture from one of its sides to the other side. A carboxylate polymer membrane shall mean a layer of polymer comprising a carboxylate ion ($SO_2^{-/+}$) within its chemical structure, wherein the carboxylate ion ($SO_2^{-/+}$) is typically located within the side chain of the polymer. An example of a generic chemical structure for a carboxylate polymer membrane would include the examples of a generic chemical structure for a sulfonated polymer membrane described hereinbefore and wherein the $SO_3^-$ ion is replaced with a $CO_2^-$ ion. Although the remainder of this discussion shall refer to sulfonated polymer membranes, it shall be understood that other ionomer membranes, such as carboxylated polymer membranes, could be used as the material from which the plates 20 are constructed.

Figure 3:
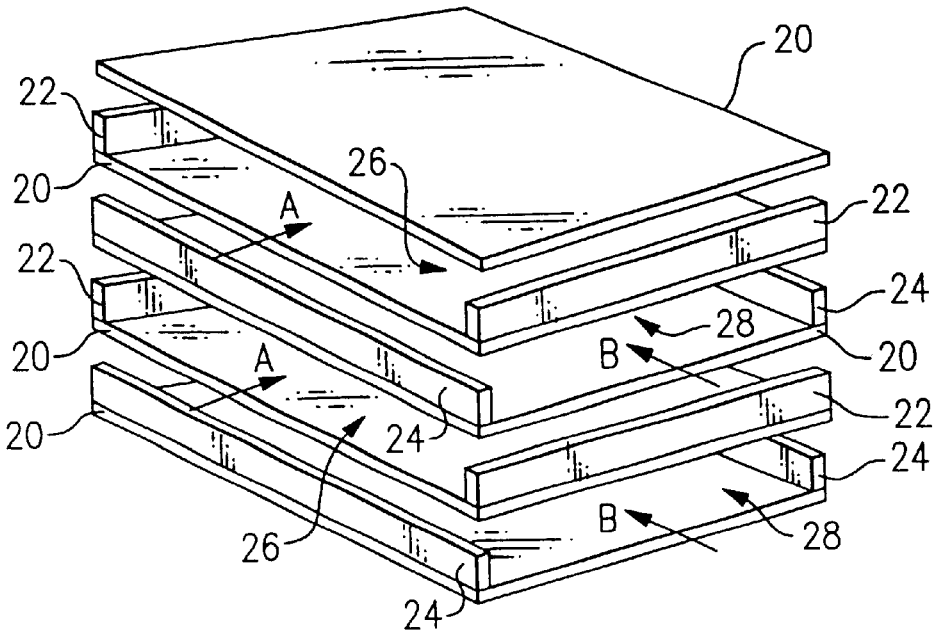
FIG. 3 illustrates the plurality of ionomer membrane plates illustrated in FIG. 2 along with spacer bars located along two sides of each plate for spacing apart the plates and sealing the passageways therebetween.

Referring to FIG. 3, each plate 20 typically is rectilinear having alternate pairs of sides (i.e., four sides). Spacer bars 22 are interposed between alternating plates 20 and located along two opposing sides of such plates 20, thereby forming an array of first passageways 26. The spacer bars 22 seal (e.g., closes or blocks) and define the first passageways 26 such that a first gas stream passes therethrough in a direction indicated by the arrow marked A. In the same respect, spacer bars 24 are interposed between alternate pairs of plates 20, other than those pairs that contain spacer bars 22, and are located along two opposing sides of such plates 20, thereby forming an array of second passageways 28. The spacer bars 24 seal and define the second passageways 28 such that a second gas stream passes therethrough in a direction indicated by the arrow marked B, which is substantially perpendicular to the arrow A. Although the spacer bars 22 and the spacer bars 24 are perpendicular to one another, thereby depicting a cross flow heat exchanger, it shall be understood that the spacer bars 22, 24 can be oriented to create a parallel or a counter flow heat exchanger. Provided the plates 20 have sufficient stiffness, the spacer bars 22, 24 not only serve as a means for sealing the sides of the plates 20 to create the alternating passageways 26, 28, but also simultaneously serve as a means for spacing the plates 20 apart from one another.

As discussed in U.S. Pat. No. 5,785,117, which is hereby incorporated by reference, an additional means for sealing the sides of the plates 20 to create the alternating passageways 26, 28, may include creating a flange with the opposite sides of the plates 20. Specifically, referring to FIG. 4, two opposing sides of a plate 20 are bent in one direction at approximately 90° to create flanges 52. The other two opposing sides of the same plate 20 are also bent in the opposite direction at approximately 90° to create flanges 54. The next adjacent plate 20 has two sets of opposing sides wherein, one set has flanges 56 bent in one direction at approximately 90° and the other set has flanges 58 bent in the opposite direction at approximately 90°. When these two plates are adjacent to one another, the flanges 54 and the flanges 56 overlap to create passageway 28 and seal the sides of such passageway. When the next pair of plates 20 are adjacent to one another, the flanges 52 and the flanges 58 overlap and create passageway 26 and seal the sides of such passageway. Although not shown, a further means for sealing a pair of plates 20 to create a passageway may include placing an adhesive tape or a face plate, or another type of obstruction between the space between of two plates 20.

Figure 5:
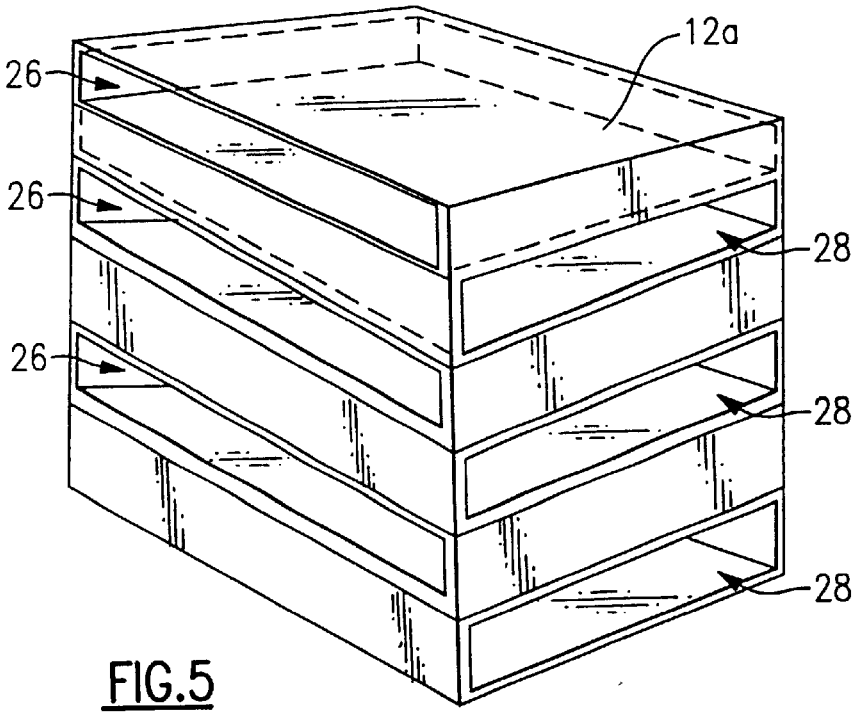
FIG. 5 is a plate-type heat exchanger of the present invention constructed of parallel spaced ionomer membrane plates.

Referring to FIG. 5, once the sealing means and the plates 20 are assembled to create the passageways 26, 28, the plate-type heat exchanger 12*a* is formed. Although this figure depicts a plate-type heat exchanger 12*a* having a total of six alternating passageways 26, 28, the plate-type heat exchanger 12*a* may have as few as two passageways, or as many passageways as are required to transfer the desirable amount of heat from one gas stream to the other. FIG. 5 illustrates a plate-type heat exchanger 12*a* having a sealing means located at the sides of the plates 20, thereby leaving the remainder of each plate 20 unsupported. Hence, it is preferable that the plates 20 have sufficient rigidity (i.e., stiffness) to prevent them from fluttering while the gas streams pass through the passageways 26, 28. Creating a plate 20 with such rigidity, however, may require increasing the thickness of the plates 20, which, in turn, may reduce its thermal efficiency. Therefore, it may be desirable to reduce the thickness of the plates 20 and insert an alternate means for providing the spacing of the parallel plates.

Figure 6:
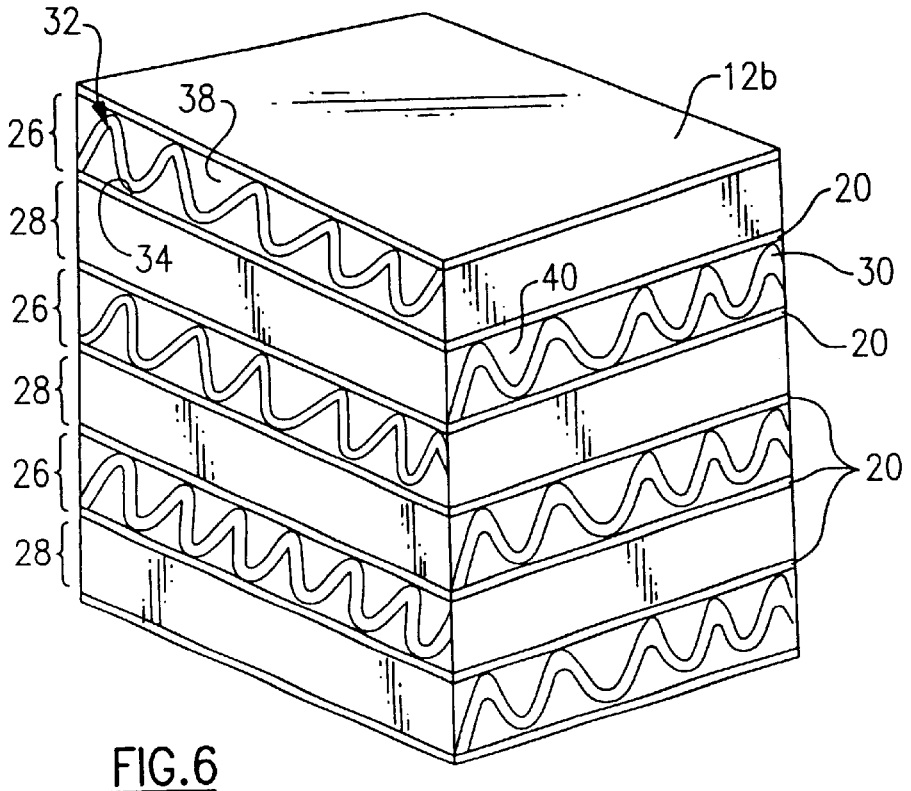
FIG. 6 is an alternate embodiment of the plate-type heat exchanger of the present invention further comprising continuous corrugated sheets interposed between the ionomer membrane plates.

Referring to FIG. 6, there is shown an alternate embodiment of the plate-type heat exchanger 12*b* of the present invention. Unlike the plate-type heat exchanger 12*a* in FIG. 5, which does not provide support across the width of the plate 20, the plate-type heat exchanger 12*b* in FIG. 6 includes a continuous corrugated sheet 30 interposed between the plates 20, thereby preventing the plates 20 from fluttering as the gas streams pass through the passageways 26, 28. The continuous corrugated sheet 30 is typically constructed of paper but may also be constructed of metal or plastic. The continuous corrugated sheet 30 also serves as an alternate means for spacing the plates 20 apart from one another. Specifically, the alternating peaks 32, 34 of the continuous corrugated sheet 30 contact the plates 20 and create a passageway for gas stream to flow in the same direction as the corrugations. Moreover, the continuous corrugated sheet 30 not only serves as a means of spacing apart the plates 20, but also simultaneously serves as a means for sealing two opposite sides of the gap between the plates 20. In other words, as the alternating peaks 32, 34 of the continuous corrugated sheet 30 contact the plates 20, the contact points act as a seal line and prevent the gas stream from flowing across the continuous corrugated sheet 30.

Figure 7:
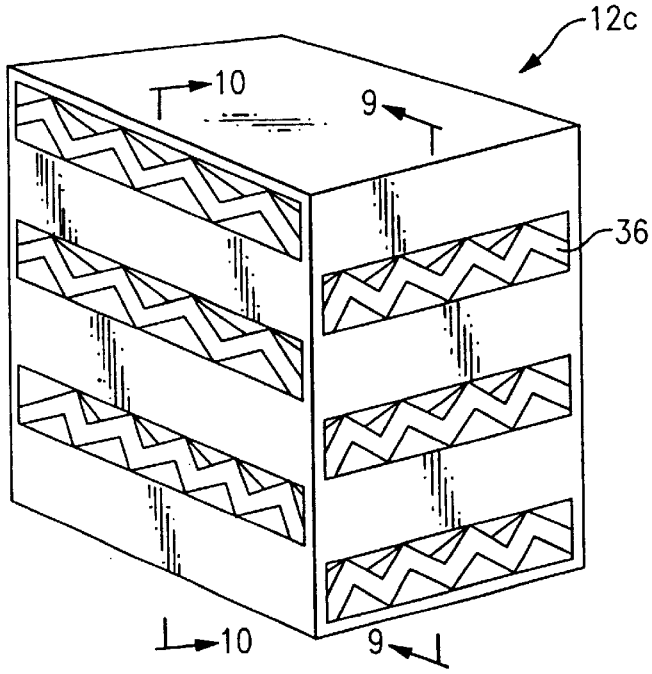
FIG. 7 is an alternate embodiment of the plate-type heat exchanger of the present invention wherein corrugated lattice structural sheets are interposed between the ionomer membrane plates to create the alternating passageways.

Referring to FIG. 7, there is shown an alternate embodiment of the plate-type heat exchanger 12*c* of the present invention. The plate-type heat exchanger 12*c* in FIG. 7 replaces the continuous corrugated sheet 30 within the plate-type heat exchanger 12*c* illustrated in FIG. 6, with a corrugated lattice structural sheet 36. Referring to FIG. 8, there is shown a three dimensional view of the corrugated lattice structural sheet 36, as described in U.S. Pat. Nos. 5,527,590, 5,679,467, and 5,962,150, which are hereby incorporated by reference. Referring to FIG. 8A, there is shown an enlarged view of a portion of the corrugated lattice structural sheet 36 in FIG. 8, constructed from a plurality of uniformly stacked pyramids in a three dimensional array. Each pyramid is constructed of intersecting cross members 60 that intersect at the vertex 61 of the pyramid. An example of such a corrugated lattice structural sheet includes that which is manufactured by Jamcorp of Wilmington, Mass. and distributed under the tradename LATTICE BLOCK MATERIAL (LBM). The corrugated lattice structural sheet 36 is typically constructed of metal, plastic, or rubber.

Unlike the continuous corrugated sheet 30, which contacts the plate 20 along the entire length of its the peaks 32 and valleys 34, the corrugated lattice structural sheet 36 only contacts the plate 20 at the vertices 61 of the pyramids, thereby reducing the surface area of the sheet that contacts the plate 20 and increasing the plate's 20 effectiveness for transferring energy from one passageway to the other. Moreover, referring back to FIG. 6, in order to transfer the heat in the portion of the passageway 26 marked 38 to the portion of the passageway 28 marked 40, the heat must pass through both the continuous corrugated sheet 30 and the plate 20. Therefore, the inclusion of the continuous corrugated sheet 30 between the plates 20 limits the amount of available surface area for the latent heat to directly pass through the plate 20 from passageway 26 to passageway 28.

Figure 4:
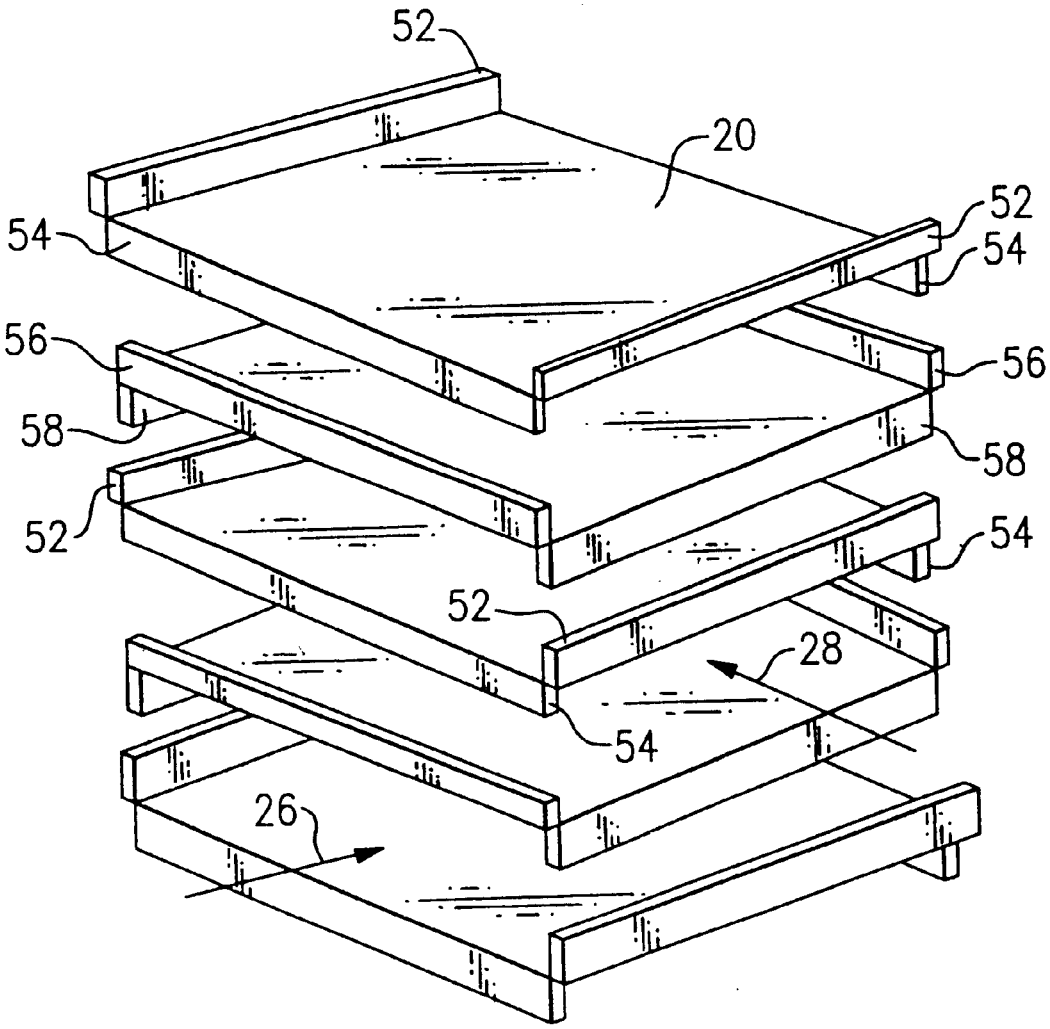
FIG. 4 illustrates an alternate means for sealing the passageways by creating flanges on opposing sides of the ionomer membrane plates.
Figure 9:
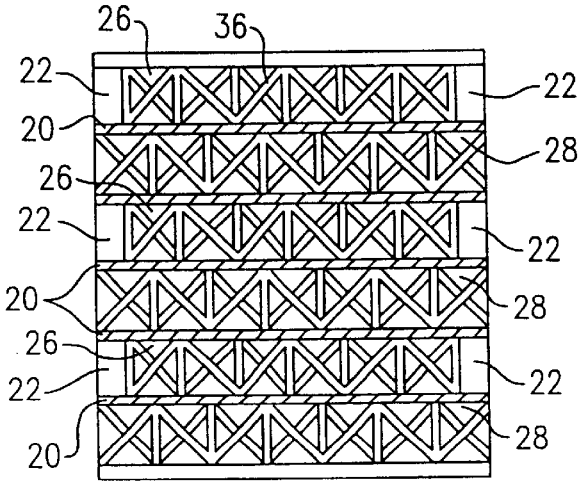
FIG. 9 is a cross section of the plate-type heat exchanger illustrated in FIG. 7, taken along line 9—9.
Figure 10:
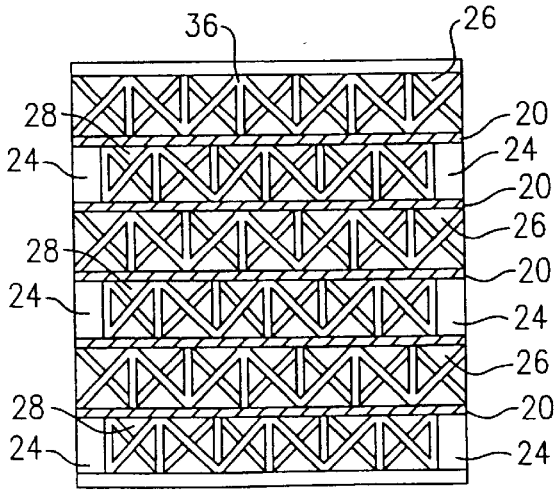
FIG. 10 is a cross section of the plate-type heat exchanger illustrated in FIG. 7, taken along line 10—10.

Referring to FIGS. 9 and 10, which are cross sections of the plate-type heat exchanger 12*c* illustrated in FIG. 7 taken along lines 9—9 and 10—10 respectively, in order to transfer heat from passageway 26 to passageway 28, the heat need only pass through the plate 20. Because the corrugated lattice structural sheet 36 is an open structure, the gas stream is able to flow freely throughout the passageways 26, 28. Additionally, because the corrugated lattice structural sheet 36 only makes point contact with the plate 20, the majority of surface area on the plate 20 is available to transfer heat from one passageway to the other. Compared to the continuous corrugated sheet 30, the corrugated lattice structural sheet 36 is a more efficient means for spacing apart the plates 20 from one another. Furthermore, the design of the lattice structural sheet 36 may mix (i.e., stir) the gas stream as it passes through the passageways 26, 28, thereby increasing the effectiveness factor of the plate-type heat exchanger 12*c*. However, because the corrugated lattice structural sheet 36 is an open structure, the plate-type heat exchanger 12*c* requires a means for sealing two opposing sides of the passageways 26, 28, thereby allowing the gas streams to pass therethrough in respective first and second directions. The sealing means may comprise spacer bars 22, 24 as illustrated in FIGS. 3 and 4 or any other sealing means discussed hereinbefore.

Figure 11:
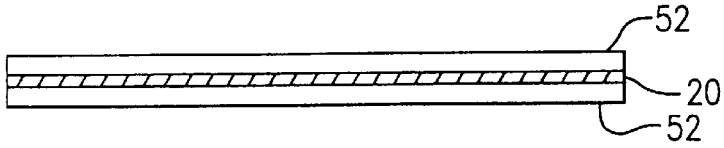
FIG. 11 is a side view of a ionomer membrane plate interposed between two planar lattice sheets.
Figure 12:
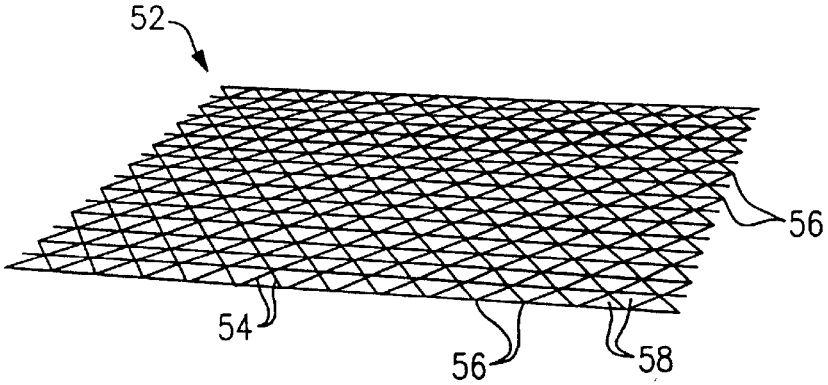
FIG. 12 depicts a planar lattice sheet.

Referring to FIG. 11, there is shown an alternate embodiment of the present invention. Specifically, FIG. 11 is a side view of a plate 20 interposed between two planar lattice sheets 52. Although this figure illustrates a planar lattice sheet 52 adjacent to both sides of the plate 20, it may be sufficient that a single planar lattice sheet 52 be adjacent to one side of the plate 20 if the mechanical characteristics of the plate 20 and/or the planar lattice sheet 52 provide adequate structural support. Referring to FIG. 12, there is shown a top view of a planar lattice sheet 52, which is constructed of a plurality of segments 54 forming an array of two dimensional trigonal structures, wherein the segments 54 intersect at intersection points 56. The planar lattice sheet 52 in FIG. 12 differs from the corrugated lattice structural sheet 36 in FIG. 8A in that the corrugated lattice structural sheet 36 typically forms three-dimensional pyramid-type structures at the intersection points of the cross members, while the planar lattice sheet 52 typically forms a two-dimensional trigonal structure from overlapping segments 54. In other words, the height of the corrugated lattice structural sheet 36 is the height of the vertex of the pyramid type structures formed therein, but the height of the planar lattice sheet 52 is equal to the thickness of the segments 54. Therefore, the corrugated lattice structural sheet 36 is typically thicker than the planar lattice sheet 52. The area indicated by reference numeral 58 is open space. Therefore, placing the sheet 20 between two planar lattice sheets 52 supports the sheet 20 and maintains its flat profile while allowing the gas streams to access the maximum amount of surface area on the plate 20 as the two gas streams pass through the passageways 26, 28.

Figure 13:
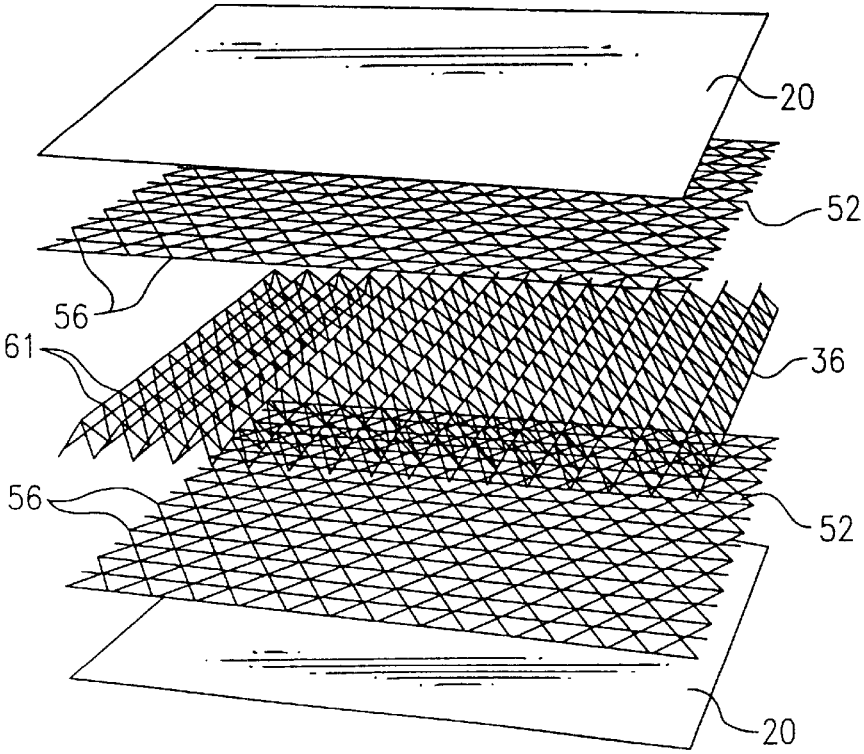
FIG. 13 illustrates a corrugated lattice structural sheet interposed between two planar lattice sheets, wherein the ionomer membrane plates are adjacent the opposite sides of the planar lattice sheets.

Referring to FIG. 13, if both the planar lattice sheets 52 and the corrugated lattice structural sheet 36 are incorporated into a plate-type heat exchanger, it is preferable to coordinate their respective designs. Specifically, it is preferable that the vertex 61 of pyramids in the corrugated lattice structural sheet 36 align (i.e., contact or connect) with the intersection points 56 of the segments 54 in the planar lattice sheet 52. Hence, two plates 20 are supported by adjacent planar lattice sheets 52, and a corrugated lattice structural sheet 36 is interposed between the planar lattice sheets 52, thereby providing maximum support for the plate-type heat exchanger 12*c* and allowing the maximum amount of energy transfer between the gas streams in the passageways 26, 28.

Figure 14:
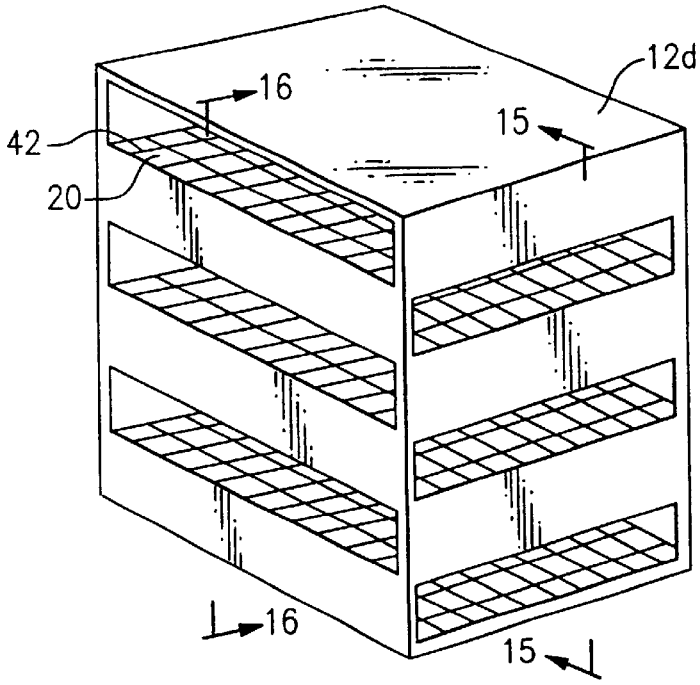
FIG. 14 is an alternate embodiment of the plate-type heat exchanger of the present invention comprising webbed sheets adjacent to the ionomer membrane plates.
Figure 15:
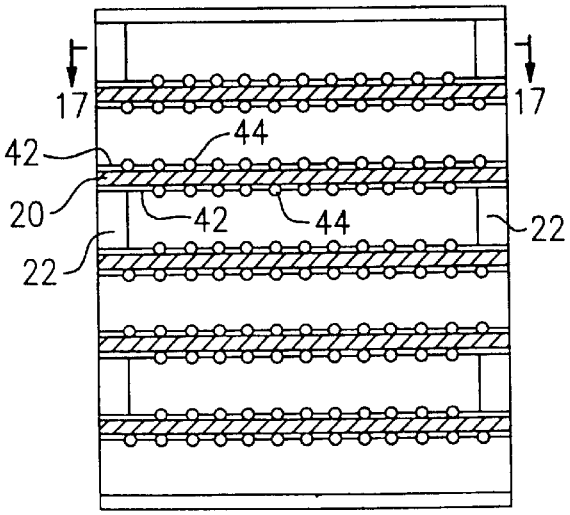
FIG. 15 is a cross section of the plate-type heat exchanger illustrated in FIG. 14, taken along line 15—15.
Figure 16:
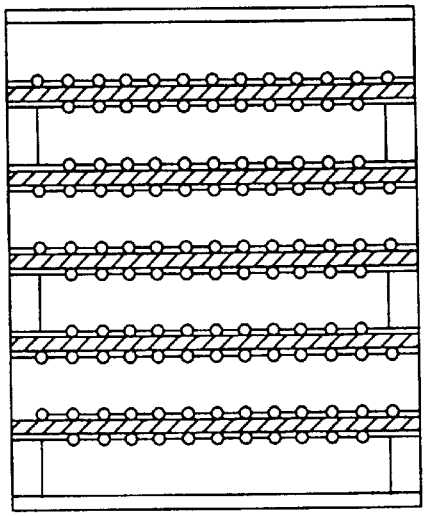
FIG. 16 is a cross section of the plate-type heat exchanger illustrated in FIG. 15, taken along line 16—16.
Figure 17:
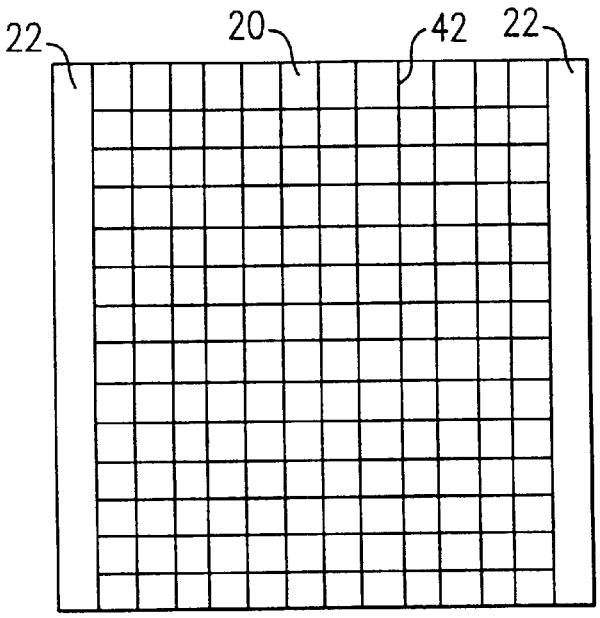
FIG. 17 is a cross section of the plate-type heat exchanger illustrated in FIG. 15, taken along line 17—17.

Referring to FIG. 14, there is shown an alternate embodiment of the plate-type heat exchanger 12*d* of the present invention. Unlike the plate-type heat exchanger 12*b* in FIG. 6 and the plate-type heat exchanger 12*c* in FIG. 7, the plate-type heat exchanger 12*d* in FIG. 14 does not include a partial obstruction, such as the continuous corrugated sheet 30 and corrugated lattice structural sheet 36, within the passageways 26, 28 to support the plates 20 or keep them apart from one another. Rather, the plates 20 in the plate-type heat exchanger 12*d* of FIG. 14 are supported by a sheet of webbed netting 42. The webbed netting 42 is typically constructed of plastic, which is compatible with the sulfonated polymer membrane such that webbed netting 42 will adhere to the membrane regardless of whether the webbed netting 42 is adjacent the membrane or embedded therein. The strand thickness and the spacing between the nodes are chosen to provide the required stiffness to the sulfonated polymer membrane, while maximizing the membrane's surface area that is exposed to the gas stream. Referring to FIGS. 15 and 16, which are cross sections of the plate-type heat exchanger 12*d* illustrated in FIG. 14 taken along lines 15—15 and 16—16 respectively, the plate 20 is interposed between sheets of webbed netting 42, which reinforces the plate 20. Referring to FIG. 17, which is a cross section of the plate-type heat exchanger illustrated in FIG. 15 taken along line 17—17, this figure illustrates the top view of the webbed netting 42 laid over the plate 20. Referring back to FIGS. 15 and 16, because the passageways 26, 28 are unobstructed, the plate-type heat exchanger 12*d* requires a means for sealing two opposing sides of the passageways 26, 28, thereby allowing the gas streams to pass therethrough in respective first and second directions. The sealing means may comprise spacer bars 22, 24 as illustrated in FIGS. 3 and 4, or any other sealing means discussed hereinbefore.

Figure 18:
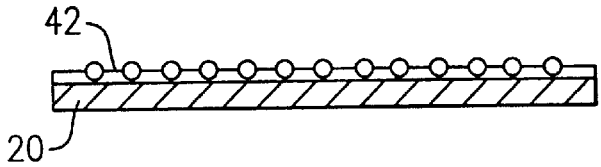
FIG. 18 is an alternate embodiment of the webbed supported ionomer membrane plate wherein one webbed sheet is adjacent the ionomer membrane plate.

Referring to FIG. 18, there is shown another alternate embodiment of the webbed supported plate illustrated in FIGS. 15 and 16. Unlike plate 20 illustrated in FIGS. 15 and 16 which is supported by a sheet of webbed netting 42 on both sides, the plate 20 in FIG. 18 is only supported by one sheet of webbed netting 42 adjacent the plate 20. Although FIG. 18 depicts the sheet of webbed netting 42 on top of the plate 20, the webbed netting 42 may also be placed below the plate 20. Therefore, depending upon the stiffness of the plate 20 and the webbed netting 42, the plate 20 may be supported by one or two sheets of webbed netting 42 that are situated above and/or below the plate 20.

Figure 19:
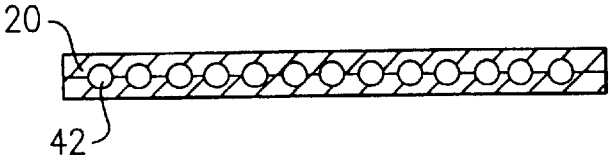
FIG. 19 is a further embodiment of the webbed supported ionomer membrane plate wherein the webbed sheet is embedded within the ionomer membrane plate.

Referring to FIG. 19, there is shown another alternate embodiment of the webbed supported plate. This figure illustrates the webbed netting 42 embedded within the plate 20, thereby increasing the stiffness of the plate 20. If the sulfonated polymer membrane is typically made from an extrusion process, this structure may be formed by casting the sulfonated polymer over the webbed netting 42.

Figure 20:
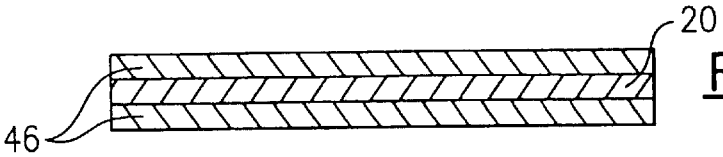
FIG. 20 is an ionomer membrane interposed between two layers of polytetrafluroehtylene.
Figure 21:
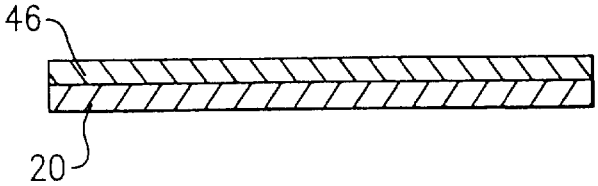
FIG. 21 is an ionomer membrane adjacent one layer of polytetrafluroehtylene.

Referring to FIG. 20, there is shown another alternate embodiment of the present invention which replaces the layers of webbed netting 42 with layers of plastic 46 to provide additional support to the plate 20. Specifically, the plate 20, which is constructed of a sulfonated polymer membrane, is interposed between two layers of plastic 46, such as polytetrafluroehtylene (PTFE), expanded polytetrafluoroethylene (ePTFE), polypropylene, or other porous (i.e., open cell) polymer film that permits air permeation while minimizing the pressure drop of the passing air stream. Referring to FIG. 21, depending upon the stiffness of the plastic layer 46 and the plate 20, the plastic layer 46 may be adjacent to one side of the plate 20, and the adjacent side may be on the top or bottom of the plate 20.

Figure 22:
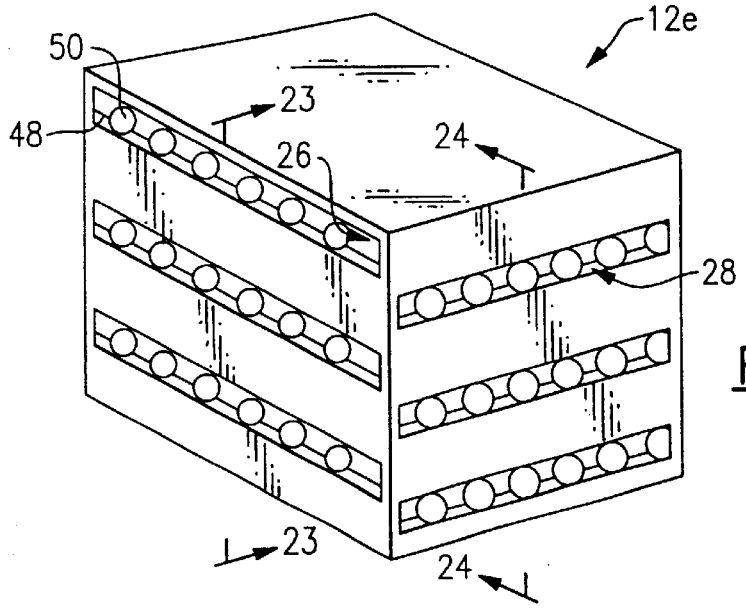
FIG. 22 is an alternate embodiment of the plate-type heat exchanger of the present invention wherein webbed sheets are interposed between the ionomer membrane plates to create the alternating passageways.
Figure 23:
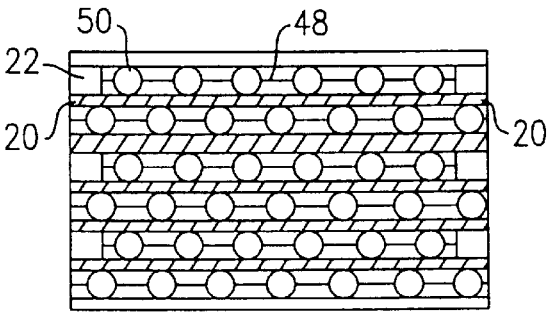
FIG. 23 is a cross section of the plate-type heat exchanger illustrated in FIG. 22, taken along line 23—23.
Figure 24:
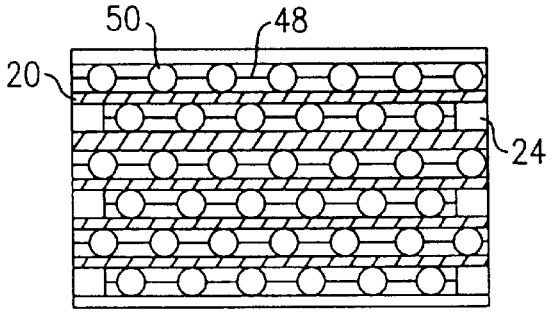
FIG. 24 is a cross section of the plate-type heat exchanger illustrated in FIG. 22, taken along line 24—24.

Referring to FIG. 22 there is shown another alternate embodiment of the plate-type heat exchanger 12*e* that includes an alternate layer of webbed netting 48 between the plates 20. Specifically, the layer of webbed netting 48 includes nodes 50 that have a diameter equal to the height of the passageways 26, 28. The nodes 50 are the intersection points of the strands. Therefore, referring to FIGS. 23 and

24, which are cross sections of the plate-type heat exchanger 12*e* illustrated in FIG. 22 taken along lines 23—23 and 24—24 respectively, the layer of webbed netting 48 is interposed between the plates 20 such that the nodes 50 contact the plates 20. This contact serves as a means for spacing apart the plates 20, which are also supported by the webbed netting 48. Because the nodes 50 are distributed within the layer of webbed netting 48, the nodes 50 do not form a seal with the plates 20. Hence, the layer of webbed netting 48 is an open structure, thereby requiring the plate-type heat exchanger 12*e* to include a means for sealing two opposing sides of the passageways 26, 28 to the gas streams to pass therethrough in respective first and second directions. The sealing means may comprise spacer bars 22, 24 as illustrated in FIGS. 3 and 4 or any other sealing means discussed hereinbefore.

Although the invention has been described and illustrated with respect to the exemplary embodiments thereof, it should be understood by those skilled in the art that the foregoing and various other changes, omissions and additions may be made without departing from the spirit and scope of the invention.

What is claimed is:

1. A plate-type heat exchanger having at least one first passageway and at least one second passageway for a first gas stream and a second gas stream to pass therethrough, respectively, comprising:

a sulfonated hydrocarbon ionomer membrane separating said passageways;

wherein said sulfonated hydrocarbon ionomer membrane comprises a sulfonated hydrocarbon copolymer;

wherein said copolymer is a selected one of a block copolymer and a random copolymer.

2. A plate-type heat exchanger as recited in claim 1, further comprising:

a three-dimensional structure disposed in at least one said passageway to maintain said passageway open.

3. A plate-type heat exchanger as recited in claim 2, wherein said three-dimensional structure comprises a plurality of uniformly stacked pyramids.

4. A plate-type heat exchanger as recited in claim 2, wherein said tree-dimensional structure increases the effectiveness factor of said plate-type heat exchanger by inducing mixing in said gas stream.

5. A plate-type heat exchanger as recited in claim 2, wherein said three-dimensional structure comprises a plurality of spacer bars.

6. A plate-type heat exchanger as recited in claim 1, further comprising:

a substantially two-dimensional reinforcement structure associated with said membrane to support said membrane.

7. A plate-type heat exchanger as recited in claim 6, wherein said substantially two-dimensional reinforcement structure comprises a two dimensional trigonal structure.

8. A plate-type heat exchanger as recited in claim 6, wherein said substantially two-dimensional reinforcement structure comprises a sheet of webbed netting.

9. A plate-type heat exchanger as recited in claim 6, wherein said substantially two-dimensional reinforcement structure comprises a layer of plastic.

10. A plate-type heat exchanger as recited in claim 9, wherein said layer of plastic comprises a selected one of polytetrafluroethylene, expanded polytetrafluroethylene, polypropylene, and an open cell polymer film.

11. A plate-type heat exchanger as recited in claim 1, further comprising a single structure that combines the functions of a three-dimensional structure disposed in at least one said passageway to maintain said passageway open and a substantially two-dimensional reinforcement structure associated with said membrane to support said membrane.

12. A plate-type heat exchanger as recited in claim 11, wherein said single structure comprises a layer of web netting including nodes having a dimension equal to a dimension of said passageway.

* * * * *

UNITED STATES PATENT AND TRADEMARK OFFICE

CERTIFICATE OF CORRECTION

PATENT NO. : 6,684,943 B2
DATED : February 3, 2004
INVENTOR(S) : Gregory M. Dobbs and James D. Freihaut It is certified that error appears in the above-identified patent and that said Letters Patent is hereby corrected as shown below:

Title page,
Item [60], Related U.S. Application Data, Provisional application No., 60/158,533 delete "Oct. 10, 1999" and replace with -- Oct. 8, 1999 --

Column 1,
Line 7, after the word "filed" delete "Oct. 10, 1999" and replace with -- Oct. 8, 1999 --

Signed and Sealed this

Twentieth Day of July, 2004

JON W. DUDAS
*Acting Director of the United States Patent and Trademark Office*